US005180255A

United States Patent [19]

Alexander

[11] Patent Number: 5,180,255

[45] Date of Patent: Jan. 19, 1993

[54] MOISTURE-IMPERVIOUS PANEL CAPABLE OF DELAYED HYDRATION

[75] Inventor: William Alexander, Naperville, Ill.

[73] Assignee: American Colloid Company, Arlington Heights, Ill.

[21] Appl. No.: 706,642

[22] Filed: May 29, 1991

Related U.S. Application Data

[62] Division of Ser. No. 481,454, Feb. 15, 1990, Pat. No. 5,053,265.

[51] Int. Cl.[5] ..... E02D 31/02

[52] U.S. Cl. ..... 405/270; 52/169.14; 405/229; 405/50

[58] Field of Search ..... 405/109, 258, 267, 270, 405/50, 229, 264; 52/169.14

[56] References Cited

U.S. PATENT DOCUMENTS 4,103,499 8/1978 Clem ..... 405/229
4,344,722 8/1982 Blais ..... 405/270
4,787,780 11/1988 Harriett ..... 405/270
4,877,358 10/1989 Ressi de Cervia ..... 405/267
5,041,330 8/1991 Heerten et al. ..... 405/109 X

*Primary Examiner*—David H. Corbin
*Attorney, Agent, or Firm*—Marshall, O'Toole, Gerstein, Murray & Bicknell

[57] ABSTRACT

A flexible or rigid panel, and method of making the panel, useful as a water barrier including an intermediate layer of a water-swellable colloidal clay, such as pentonite, sandwiched between two layers of sheet material, such as woven or non-woven fabric, or paperboard, wherein at least one of the sheet material layers has a water-soluble coating material covering substantially the entire outer surface of the sheet material layer. The water-soluble coating is a material that dissolves upon a predetermnined water contact period, having a controlled, predetermined water-solubility so that the intermediate water-swellable clay layer is protected against hydration during installation.

10 Claims, 4 Drawing Sheets

MOISTURE-IMPERVIOUS PANEL CAPABLE OF DELAYED HYDRATION

CROSS REFERENCE TO RELATED APPLICATION

This application is a divisional of co-pending application Ser. No. 07/481,454 filed Feb. 15, 1990, now U.S. Pat. No. 5,053,265.

FIELD OF THE INVENTION

The present invention is directed to a moisture-impervious panel coated with a material that requires a predetermined water contact time for solubility to prevent premature hydration of the panel during installation. The panel then is capable of being rapidly hydrated after installation and contact with water. More particularly, the present invention is directed to a moisture-impervious panel preformed from a pair of spaced flexible, or rigid, e g. paperboard, facing sheets filled therebetween with an intermediate layer of water-swellable clay, such as bentonite. In order to prevent premature hydration of the intermediate water-swellable clay layer, at least one of the facing sheets is coated with a desired thickness of a water-soluble coating material so that the intermediate water-swellable clay layer will not be hydrated during installation of the panel, such as by contact with rain water.

BACKGROUND OF THE INVENTION AND PRIOR ART

It is well known to provide seepage resistant structures using water-swellable clays, such as bentonite, disposed across a path of possible seepage or flow. For example, this assignee's Bechtner U.S. Pat. No. 2,277,286 discloses the use of bentonite clay filled between spaced forms or bulkheads, such as wood, masonry or other suitable materials to hold the bentonite in place. Another of this assignee's prior patents to Arthur G. Clem U.S. Pat. No. 3,186,896 discloses a moisture-impervious panel preformed from spaced paperboard sheets interconnected with an intermediate layer of a water-swellable clay, such as bentonite, that has been used for many years by this assignee as a waterproofing barrier. When subjected to leakage or seepage of water, the outwardly extending water-pervious paper or cardboard facing sheet will absorb the water and pass the water through the facing sheet contact with the intermediate layer of water-swellable clay thereby permitting the clay to hydrate, swell and block the passage of water completely through the panel.

One of the problems prevalent with the use of the moisture-impervious panels disclosed in Clem U.S. Pat. No. 3,186,896 is that the paper or cardboard facing sheets sometimes are hydrated prior to complete installation, for example, when the panels are being installed and are wetted with rain water. Hydration prior to complete installation causes lateral movement of the swelled clay outwardly from between the facing sheets so that it is very difficult, if not impossible to fit two adjacent panels securely together without clay voids between adjacent panels. When adjacent panels are not fitted tightly together during installation, water first contacting the panels flows laterally over the facing sheets and finds a clay void space between adjacent panels so that water can penetrate between adjacent panels, at one or more of these clay void space locations before the intermediate water-swellable clay layer has had sufficient time to hydrate sufficiently and swell laterally to fill such clay void spaces. Though such water damage will probably be of a relatively minor consequence, caused during a relatively short period of time until the intermediate water-swellable clay layer has had sufficient water contact for hydration, such water damage can be substantial and can create damage areas capable of substantial water penetration over time in addition to being very costly to excavate and repair. Although this problem has existed since the first use of these water-impervious panels, for over twenty years, presenting a long-felt need in this art, to date this problem has not been solved.

Many attempts have been made to improve upon the water-impermeability of multi-layer articles of manufacture containing bentonite. The following patents represent efforts to provide a water-impervious sheet material containing adhesively secured water-swellable clays: Clem U.S. Pat. No. 4,467,015; Clem U.S. Pat. No. 4,501,788; McGroarty et al U.S. Pat. No. 4,693,923; Harriett U.S. Pat. No. 4,656,062; and Harriet U.S. Pat. No. 4,787,780. Other patents disclose the use of water-impermeable layers for protecting a soil surface, such as British patent specification 1,059,363; British patent specification 1,029,513 and British patent specification 1,129,840. Blias U.S. Pat. No. 4,344,722 discloses a water barrier constructed in the field by applying a first flexible, water-permeable fabric layer to a soil surface, overlaying a thickness of water-swellable clay material, and applying an overlayer of the same flexible, water-permeable fabric thereover. This eliminates the need for applying an adhesive to secure the clay to fabric sheets, but is expensive since the barrier material cannot be preformed but must be constructed in the field. U.K. published patent application GB 2,202,185A discloses a layer of water-swellable bentonite between flexible layers that have been needle punched together in a needle loom.

While many of the above-described prior art multi-layer, water-impermeable, bentonite-containing materials undoubtedly permit rapid hydration of the intermediate water-swellable clay layer, none of these patents have addressed the problem of preventing prehydration of bentonite panels by providing a water soluble coating material to a surface of the panel, for protection during installation.

SUMMARY OF THE INVENTION

In brief, the present invention is directed to a flexible or rigid panel, and method of making the panel, useful as a water barrier including an intermediate layer of a water-swellable colloidal clay, such as bentonite, sandwiched between two layers of sheet material, such as woven or non-woven fabric, or paperboard, wherein at least one of the sheet material layers has a water-soluble coating material covering substantially the entire outer surface of the sheet material layer. The water-soluble coating is a material that dissolves upon a predetermined water contact period, having a controlled, predetermined water-solubility so that the intermediate water-swellable clay layer is protected against hydration during installation.

Accordingly, an object of the present invention is to provide a water barrier and a method of manufacturing the water barrier including an intermediate layer of a water-swellable colloidal clay, such as bentonite, sandwiched between opposed facing sheets, wherein at least one of the facing sheets is initially coated with a water-soluble coating material to prevent premature clay hydration.

Another object of the present invention is to provide a rigid water barrier panel and method of manufacturing the water barrier panel, including opposed rigid facing sheets secured to an intermediate layer of a compacted water-swellable clay, such as bentonite, wherein at least one of the facing sheets has its outwardly facing surface coated with a water-removable coating material to prevent penetration of water into the intermediate water-swellable clay layer during handling and installation of the panels.

Still another object of the present invention is to provide a water barrier and a method of manufacturing the water barrier including an intermediate layer of a water-swellable colloidal clay, such as bentonite, sandwiched between opposed facing sheets, with an optional intermediate support sheet, wherein at least one of the facing or intermediate support sheets is relatively rigid to provide rigidity to the overall panel construction, wherein the panels are initially coated on at least one outer facing sheet surface with a water-soluble coating material to prevent premature clay hydration.

A further object of the present invention is to provide a new and improved water barrier and method of manufacturing the water barrier, including an intermediate layer of water-swellable colloidal clay sandwiched between opposed facing sheets including completely coating at least one exterior panel surfaces with a layer of material having a predetermined water solubility, in a desired thickness, so that water cannot penetrate the facing sheet to contact the intermediate water-swellable clay layer until after removal of the coating material by solubilization.

The above and other objects and advantages of the present invention will become more apparent with reference to the drawings and detailed description of the preferred embodiments.

DETAILED DESCRIPTION OF THE PREFERRED EMBODIMENTS

In accordance with the present invention, a flexible or rigid moisture-impervious, bentonite-containing panel is constructed to include a water-soluble coating material completely covering an outwardly facing exterior surface for prevention of hydration during installation while retaining the capability of being rapidly hydrated after installation and contact with water. The moisture-impervious panel of the present invention is preformed from a pair of spaced facing sheets, such as paperboard sheets, and, optionally, an intermediate support sheets. In one embodiment, at least one of the facing or intermediate support sheets provides rigidity to the panel. In order to prevent premature hydration of the intermediate water-swellable clay layer, at least one of the exterior facing sheets is coated with a desired thickness of a water-soluble coating material having controlled, predetermined water-solubility, so that the intermediate water-swellable clay layer will not be hydrated during installation of the panel, such as by contact with rain water. The intermediate water-swellable clay layer is easily hydrated by normal water contact after solubilization and removal of the coating material, after installation.

Figure 1:
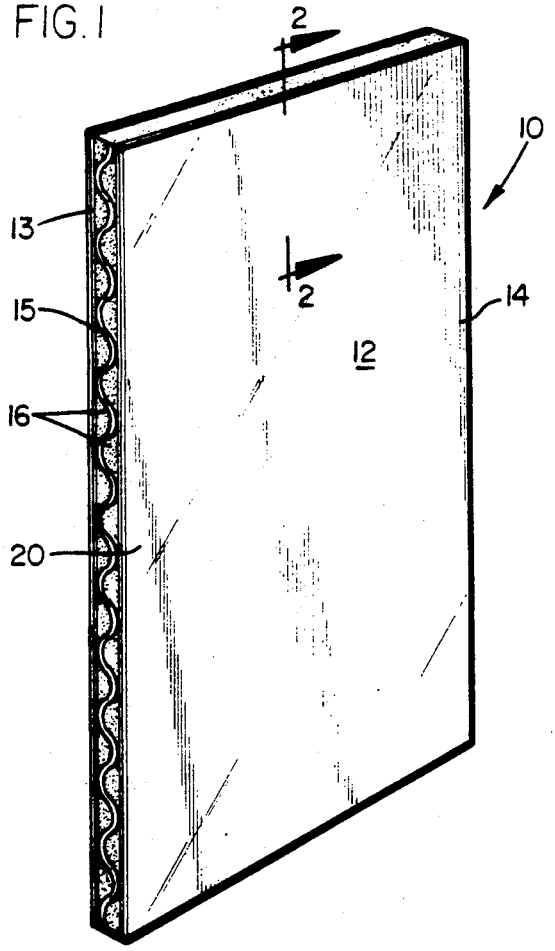
FIG. 1 is a perspective view of the rigid, moisture-impervious panel of the present invention.
Figure 2:
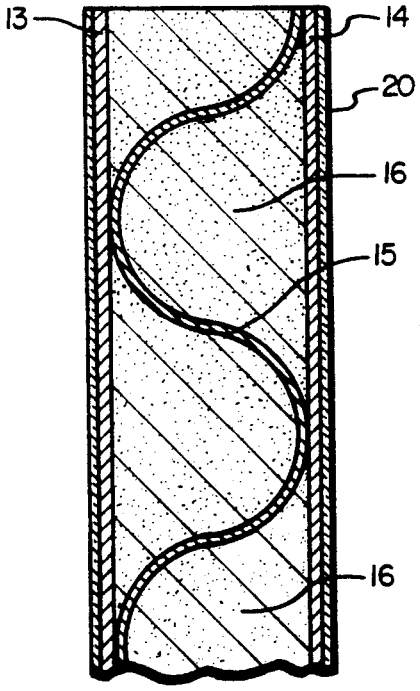
FIG. 2 is an enlarged, partially broken away side view of the panel of FIG. 1 taken along line 2—2 of FIG. 1.
Figure 5:
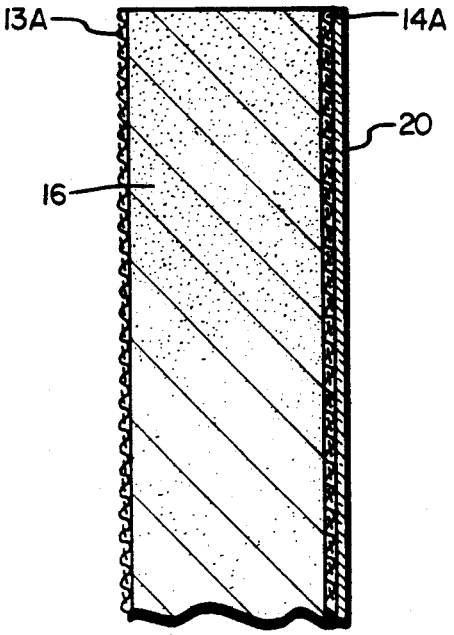
FIG. 5 is an enlarged, partially broken away side view of another embodiment of the panel of the present invention wherein the panel is formed from flexible fabric exterior layers, at least one of the exterior layers coated with a water-soluble coating material.
Figure 3:
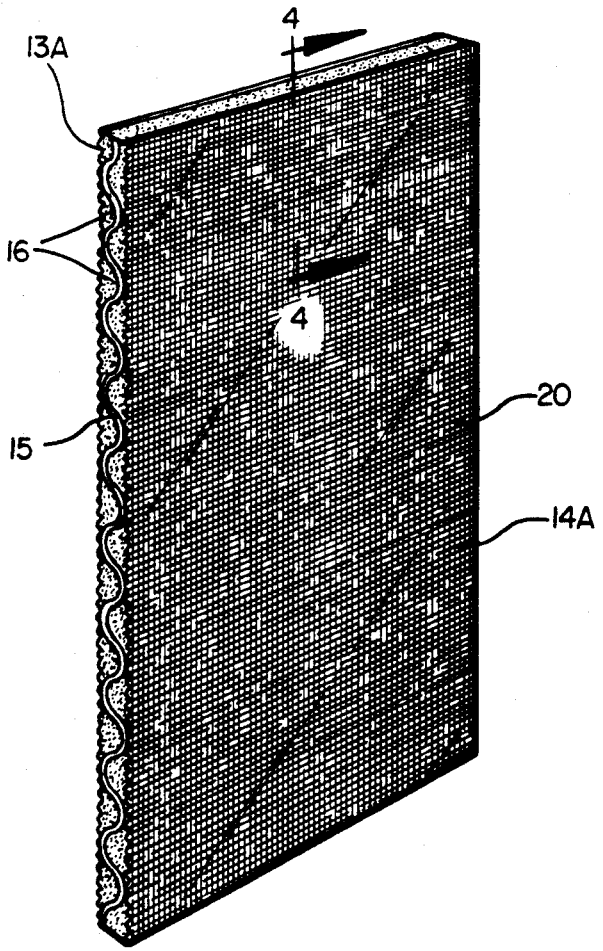
FIG. 3 is a perspective view of another embodiment of the rigid panel of the present invention showing the exterior facing sheets formed of flexible fabrics.

Turning now to the drawings, and initially to FIGS. 1—3, there is illustrated a new and improved preformed water barrier panel, generally designated by reference numeral 10, and formed of a corrugated paperboard carrier or form, generally designated 12, including a pair of spaced paperboard facing sheets 13 and 14, joined and interconnected by a paper corrugated strip 15 to form a plurality of voids between the strips 15 and the facing sheets 13 and 14. The voids are filled with a compacted mass of finely divided water-swellable clay 16. It will be appreciated that the panel 10 may be preformed and assembled into a moisture-impervious structure which may be readily sawed or cut to the desired shape in the field.

The water-swellable colloidal clay utilized as the sandwiched clay layer 16 between facing sheets 13 and 14 is any water-swellable colloidal clay which will hydrate in the presence of water, i.e., will swell in the presence of water. In accordance with one important embodiment of the present invention, the colloidal clay is bentonite. A preferred bentonite is sodium bentonite which is basically a hydratable montmorillonite clay of the type generally found in the Black Hills region of South Dakota and Wyoming. This clay has sodium as a predominant exchange ion. However, the bentonite utilized in accordance with the present invention may also contain other cations such as magnesium and iron. There are cases wherein a montmorillonite predominant in calcium ions can be converted to a high swelling sodium variety through a well known process called "peptizing". The colloidal clay utilized in this invention may be one or more peptized bentonites. The colloidal clay also may be any member of the dioctahedral or trioctahedral smectite group or mixtures thereof. Examples are Beidellite, Nontronite, Hectorite and Saponite. To achieve the full advantage of the present invention, the colloidal clay, i.e., bentonite, generally is finely divided as known for use in water barrier panels and the like, i.e., 20 to 350 mesh, preferably 20 to 50 mesh.

Figure 6:
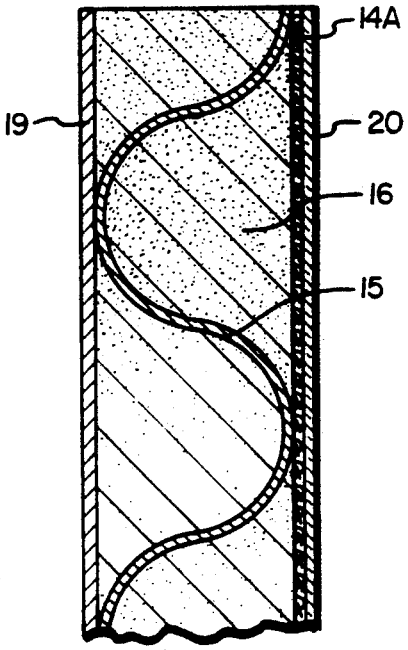
FIG. 6 is an enlarged, partially broken away side view of another embodiment of a rigid panel manufactured in accordance with the principles of the present invention, having one rigid facing sheet and one flexible fabric facing sheet, and showing an optional corrugated strip therebetween.
Figure 4:
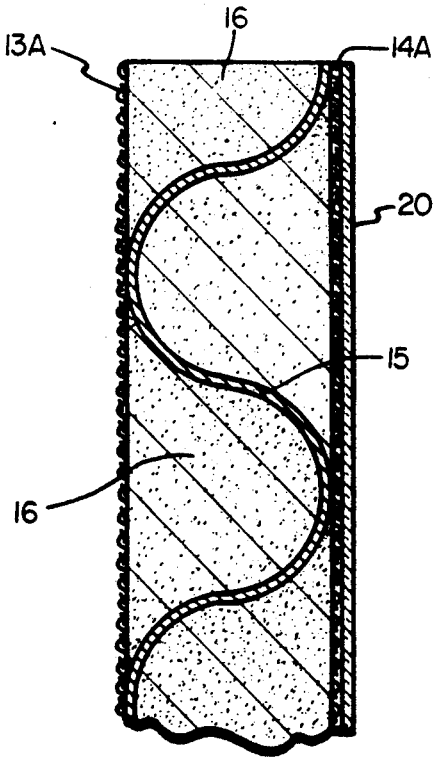
FIG. 4 is an enlarged, partially broken away side view of panel of FIG. 4, taken along the line 5—5 of FIG. 4.

The facing sheets 13, 14, and 19 and the corrugated paper strip 15 shown in FIGS. 1,2 and 6 are illustrated as paperboard or cardboard, but any material including flexible woven, or non-woven fabrics also are suitable. For example, the centrally disposed corrugated strip 15 could be a rigid plastic, e.g., a rigid polyolefin provided with water channels or openings (not shown) to provide for fluid communication between entering water and the entire intermediate clay layer 16, on both sides of the strip 15. Similarly, as shown in FIGS. 3 and 4, corrugated strip 15 can be a paperboard sheet while the facing sheets 13A and 14A are made from a flexible woven or non-woven fabric that contains natural apertures or water channels between filaments or strands of fabric material. Alternatively, one of the facing sheets 13 or 14 could be a rigid plastic, e.g., polyethylene, that is water-impermeable.

It is undesirable to permit hydration of the intermediate clay layer 16 prior to the panels 10 being confined, such as by soil backfilling, since the water-swellable clay will expand laterally, and outwardly from between the facing sheets. Laterally expanded clay that oozes outwardly from the panels 10, prior to complete installation, may be lost or unavailable where needed when installation is completed, whether or not complete drying of the panel has occurred prior to completion of installation. For example, clay that laterally moves outwardly from between facing sheets 13 and 14 of panels 10 may not return to the original location after drying, and may be lost if backfilling is completed prior to complete drying of the panels 10.

In accordance with an important feature of the present invention, it has been found that a layer of material 20 of controlled, predetermined water-solubility, protects the panels from premature hydration during handling and installation. Suitable water-soluble materials capable of sustaining a predetermined number of rainfalls, and the like, during installation and handling are easily removed upon sustained water contact, such as water in soil used for backfilling, after installation. Optionally, the soil 21 adjacent the panels can be saturated with water after installation to remove the coating material, after a contact period, to ensure that the panels are ready for immediate water penetration.

Some of the suitable coating materials include the following: Gums, such as guar, arabic, ghatti, tragacanth, agar, xanthan, karaya, locust bean, acacia, carrageenan, silicone gums, mixtures, and the like; modified celluloses, such as hydroxyethylcellulose, hydroxypropylcellulose, hydroxybutycellulose, carboxymethylcellulose, sodium carboxymethylcellulose, and the like; gelatin; starch; modified starches; nonionic surfactants of sufficient molecular weight and water solubility, (i.e., molecular weight of at least 600 and an HLB number of at least 8), such as nonoxynols, oxtoxynols, ethoxylated (or propoxylated) fatty alcohols, ethoxylated (or propoxylated) fatty acids or amides, ethoxylated (or propoxylated) fatty amines and dodoxynols, mixtures, and the like; polyacrylates, and their copolymers, crosslinked sufficiently for a desired water-solubility, e.g., weight average molecular weight of about 200 to about 100,000, such as polyacrylic acid, polyacrylamide, polyvinylpyrrolidones, polyvinylalcohols, polyethyleneimines, polyacrylonitrile, polymethylmethacrylate, and the like; glassy phosphates; glassy silicates; EMA (ethylene maleic anhydride); SMA (styrene maleic anhydride); functionalized silicones; silicone polymers; waxes (together with an emulsifier), for example carnauba wax, beeswax, microcrystalline wax, and the like; polyhydric alcohols, such as glycerin, ethylene glycol, propylene glycol, sorbitol, polyglycols (such as triethylene glycol), and the like; fatty alcohols; and fatty amines. The above polymers should be lightly crosslinked (e.g., wt. av. molecular wt. of about 200 to about 100,000) to provide sufficient water-insolubility for removal over a desired sustained water contact.

The preferred material is a wax obtained from National Wax Company called FRESHLOK 195 having the following specifications:

| | |
|---|---|
| Congealing Point (ASTM D-938) | 142–148° F. |
| Needle Penetration at 77° F. (ASTM D-1321) | 6.0–9.0 |
| ASTM Color (ASTM D-1500) | 1.5 Max. |
| Brookfield Viscosity (ASTM D-2669) | |
| at 300° F. | 105–125 cps |
| at 250° D. | 195–225 cps |
| at 240° F. | 225–255 cps |
| at 220° F. | 300–340 cps |
| at 200° F. | 420–470 cps |
| Suggested Application Temperature | 200°–225° F. |
| Blocking Point | 130° F. |

Figure 7:
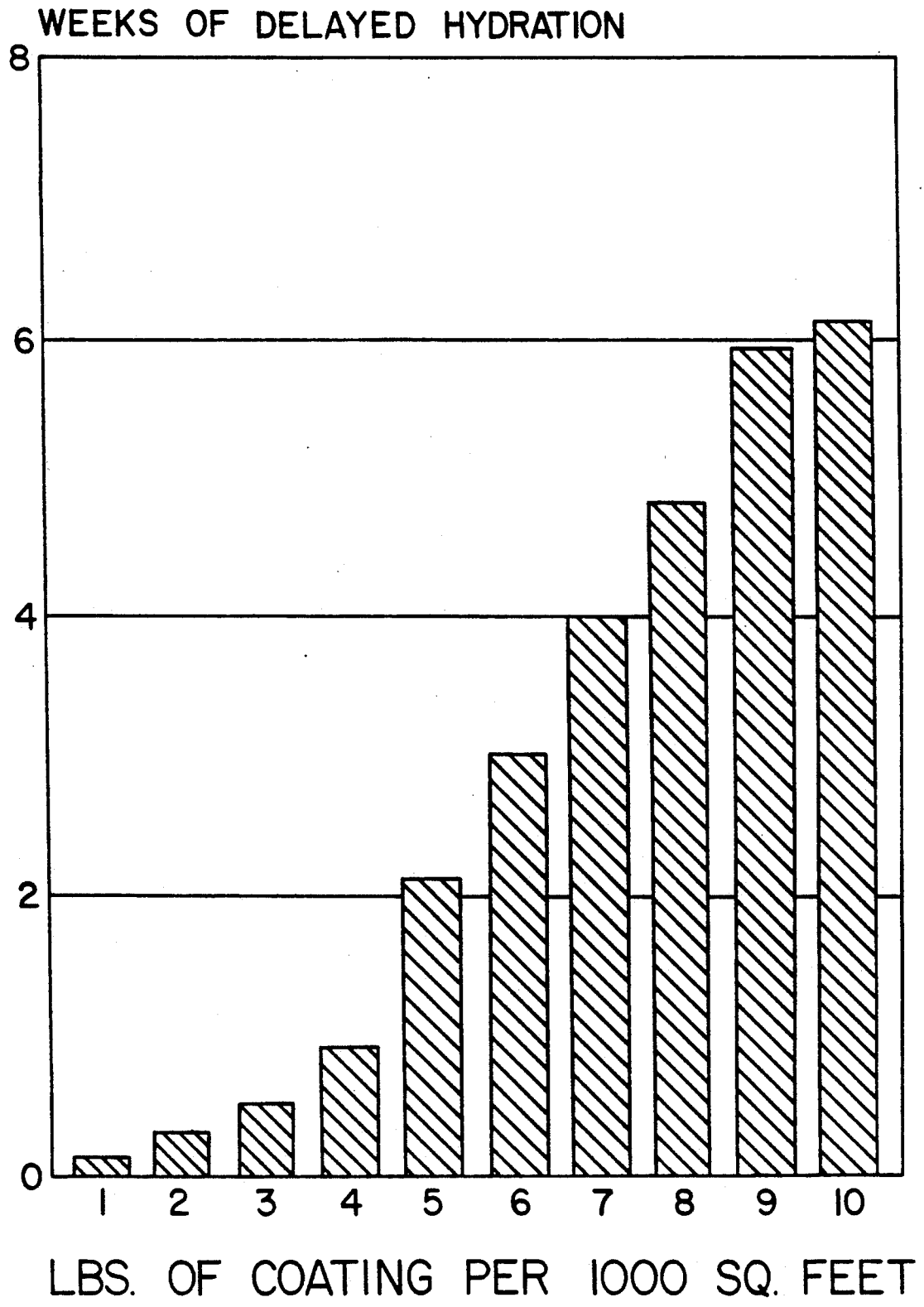
FIG. 7 is a graph showing the time required for panel hydration when coated with different thicknesses of FRESHLOK 195, a wax coating material.
Figure 8:
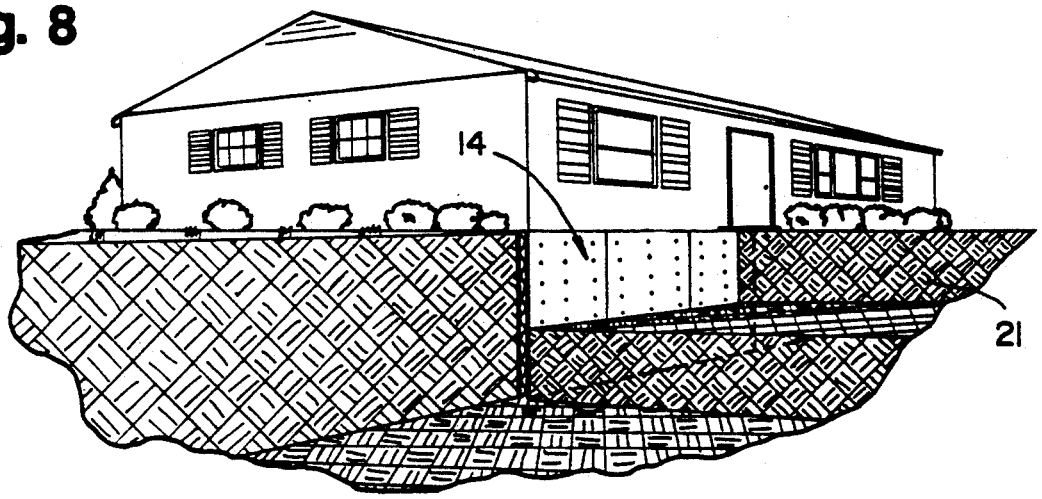
FIG. 8 is a perspective view showing the panel of the present invention disposed in place against a structure, having back-fill material (an overlayer of material) being filled against the coating material.

This material, when applied to facing sheet 14 will be completely removed upon immersion in water in different periods of time, depending upon the thickness applied, as shown in TABLE I, and FIG. 7:

TABLE I

| LBS OF COATING PER 100 SQUARE FEET | DELAYED HYDRATION IN WEEKS |
|---|---|
| 1 | 0.1 |
| 2 | 0.3 |
| 3 | 0.5 |
| 4 | 0.9 |
| 5 | 2.1 |
| 6 | 3.0 |
| 7 | 4.0 |
| 8 | 4.8 |
| 9 | 5.9 |
| 10 | 6.1 |

The coating material is applied in any desired amount, depending upon how much water contact, e.g., number of rains, is anticipated during handling and installation. Other materials having more or less water solubility are coated in whatever coating thickness is needed to achieve the desired delay in hydration of the intermediate water-swellable clay layer.

It should be understood that the present disclosure has been made only by way of preferred embodiment and the numerous changes in details of construction, combination and arrangement of parts can be resorted to without departing from the spirit and scope of the invention as hereunder claimed.

I claim:

1. A method of preventing water from contacting a structure comprising installing a multi-layer article of manufacture against said structure;

said multi-layer article including first and second sheet material layers having a layer of water-swellable clay therebetween, such that said first sheet material layer is disposed against the structure and the second sheet material layer is water penetratable and includes inner and outer surfaces, said outer surface facing outwardly from said structure, said outer surface including a water-soluble coating layer of material removable by water contact; and disposing an overlayer of material against said coating layer of said article during installation to sandwich the multi-layer article between said structure and the overlayer of material, such that water-penetrating said overlayer of material will remove the coating layer to thereafter permit water to penetrate the second sheet material layer and contact the water-swellable clay causing the clay to hydrate and prevent substantial water contact with the structure, said coating layer requiring about 0.1 to about 6.1 weeks in contact with water for complete removal from the exterior of the second sheet material layer.

2. The method of claim 1 wherein said material disposed over said article during installation is sand.

3. The method of claim 1 wherein the first and second facing sheets are formed of paperboard.

4. The method of claim 1 wherein at least one of the facing sheets is a flexible fabric layer.

5. The method of claim 1 wherein the second sheet material layer is flexible sheet material that is water-penetrable.

6. The method of claim 3 wherein the multilayer is rigid and includes a corrugated paperboard strip disposed between the first and second paperboard sheets filled between the corrugations and the paperboard sheets with said water-swellable clay.

7. A method of preventing water from contacting a structure comprising installing a multi-layer article of manufacture against said structure;

said multi-layer article including first and second sheet material layers having a layer of water-swellable clay therebetween, such that said first sheet material layer is disposed against the structure and the second sheet material layer is water penetratable and includes inner and outer surfaces, said outer surface facing outwardly from said structure, said outer surface including a coating layer of material removable by water contact; and disposing an overlayer of material against said coating layer of said article during installation to sandwich the multi-layer article between said structure and the overlayer of material, such that water-penetrating said overlayer of material will remove the coating layer to thereafter permit water to penetrate the second sheet material layer and contact the water-swellable clay causing the clay to hydrate and prevent substantial water contact with the structure, said coating layer requiring about 0.1 to about 6.1 weeks in contact with water for complete removal from the exterior of the second sheet material layer, said coating layer being selected from the group consisting of guargum, gum arabic, ghatti gum; gum tragacanth; agar gum; karaya gum; locust bean gum; acacia gum; gum carrageenan; silicone gum; hydroxyethyl cellulose; hydroxypropylcellulose; hydroxybutylcellulose; carboxymethylcellulose; sodium carboxymethycellulose; gelatin; starch; modified starch; nonionic surfactants having a molecular weight of at least 600 and an HLB number of at least 8; an incompletely crosslinked polyacrylate; a copolymer including an acrylate as one of the monomer units, polyacrylic acid, polyacrylamide; polyvinylpyrrolidone; polyvinyl alcohol; polyethyleneimine; polyacrylonitrile; polymethylmethacrylate; a glassy phosphate; a glassy silicate; ethylene maleic anhydride; styrene maleic anhydride; a functionalized silicone; a silicone polymer; carnauba wax; beeswax; microcrystalline wax; a polyhydric alcohol; a fatty alcohol; a fatty amine; and mixtures.

8. The method of claim 7 wherein the first and second facing sheets are formed of paperboard.

9. The method of claim 7 wherein at least one of the facing sheets is a flexible fabric layer.

10. The method of claim 8 wherein the multilayer article is rigid and includes a corrugated paperboard strip disposed between the first and second sheet material layers filled between the corrugations and the sheet material layers with said water-swellable clay.

* * * * *